US010384842B2

(12) United States Patent
Kim

(10) Patent No.: US 10,384,842 B2
(45) Date of Patent: Aug. 20, 2019

(54) COMPACT CONTAINER PROVIDED WITH AIRTIGHT PACKING HAVING UPPER AND LOWER SEALING RUBBERS AND COUPLING TENSION PROTRUSION

(71) Applicant: AMOREPACIFIC CORPORATION, Seoul (KR)

(72) Inventor: Jun Young Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 25 days.

(21) Appl. No.: 15/527,834

(22) PCT Filed: Nov. 19, 2015

(86) PCT No.: PCT/KR2015/012454
§ 371 (c)(1),
(2) Date: May 18, 2017

(87) PCT Pub. No.: WO2016/085193
PCT Pub. Date: Jun. 2, 2016

(65) Prior Publication Data

US 2017/0320646 A1 Nov. 9, 2017

(30) Foreign Application Priority Data

Nov. 24, 2014 (KR) ..... 10-2014-0164119

(51) Int. Cl.
*A45D 33/34* (2006.01)
*B65D 53/02* (2006.01)
(Continued)

(52) U.S. Cl.
CPC ..... *B65D 53/02* (2013.01); *A45D 33/24* (2013.01); *A45D 34/00* (2013.01); *A45D 40/22* (2013.01);
(Continued)

(58) Field of Classification Search
CPC ..... A45D 33/24; A45D 34/00; A45D 40/22; A45D 2200/051; B65D 53/02; B65D 43/163; B65D 43/26
(Continued)

(56) References Cited

U.S. PATENT DOCUMENTS 5,199,451 A * 4/1993 Montoli ..... A45D 40/22 132/294
5,353,818 A * 10/1994 Suzuki ..... A45C 13/008 132/294
(Continued)

FOREIGN PATENT DOCUMENTS

JP 2002-065355 3/2002
JP 2005-334390 12/2005
(Continued)

*Primary Examiner* — J. Gregory Pickett
*Assistant Examiner* — Niki M Eloshway
(74) *Attorney, Agent, or Firm* — Heedong Chae; Lucem, PC

(57) ABSTRACT

The present invention relates to a compact container provided with an airtight packing having upper and lower sealing rubbers, and a coupling tension protrusion, in which the airtight packing is coupled on top of a refill container, wherein the upper sealing rubber is brought into close contact with a refill container cover and the lower sealing rubber is brought into close contact with the refill container, so as to render airtight a cosmetic material accommodating space, thereby preventing cosmetic material from evaporating or becoming volatile to allow the cosmetic material to function properly for a long time. Also, the cosmetic material accommodation space in the refill container is maximized by removing an existing middle container and directly coupling the refill container to a container main body, thereby enabling effective filling of more cosmetic material to minimize frequent refilling of the cosmetic material.

9 Claims, 7 Drawing Sheets

(51) Int. Cl.

| | |
|---|---|
| ***A45D 34/00*** | (2006.01) |
| ***A45D 40/22*** | (2006.01) |
| ***B65D 43/16*** | (2006.01) |
| ***B65D 43/26*** | (2006.01) |
| ***A45D 33/24*** | (2006.01) |

(52) U.S. Cl.
CPC ..... *B65D 43/163* (2013.01); *B65D 43/26* (2013.01); *A45D 2200/051* (2013.01)

(58) Field of Classification Search
USPC ..... 220/263, 528, 849; 132/294
See application file for complete search history.

(56) References Cited

U.S. PATENT DOCUMENTS 5,950,639 A * 9/1999 Suzuki ..... A45C 13/008 132/294
6,173,719 B1 * 1/2001 Petit ..... A45D 33/008 132/293
7,832,564 B2 * 11/2010 Kim ..... A45D 33/008 132/293
2006/0151355 A1 * 7/2006 Oh ..... A45D 33/008 206/581
2016/0161359 A1 * 6/2016 Kang ..... A45D 34/00 73/49.3

FOREIGN PATENT DOCUMENTS

| | | | |
|---|---|---|---|
| JP | 2010-246708 | A | 11/2010 |
| KR | 2000-0019770 | U | 11/2000 |
| KR | 20-0409415 | Y1 | 2/2006 |
| KR | 10-1112477 | B1 | 2/2012 |
| KR | 10-1297822 | | 8/2013 |
| KR | 10-1355364 | B1 | 1/2014 |

* cited by examiner

COMPACT CONTAINER PROVIDED WITH AIRTIGHT PACKING HAVING UPPER AND LOWER SEALING RUBBERS AND COUPLING TENSION PROTRUSION

CROSS-REFERENCE TO RELATED APPLICATION

This application claims the benefit of Korean application No. 10-2014-0164119, filed on Nov. 24, 2014 with the Korean Intellectual Property Office, the disclosure of which is incorporated herein by reference.

TECHNICAL FIELD

The present invention relates to a compact container provided with an airtight packing having upper and lower sealing rubbers, and a coupling tension protrusion, and more specifically, to a compact container provided with an airtight packing having upper and lower sealing rubbers, and a coupling tension protrusion, in which the airtight packing is coupled on top of a refill container, wherein the airtight packing is integrally formed with the upper and lower sealing rubbers made from a rubber material, wherein the upper sealing rubber is brought into close contact with a refill container cover and the lower sealing rubber is brought into close contact with the refill container, so as to render airtight a cosmetic material accommodating space, thereby preventing cosmetic material from evaporating or becoming volatile to allow the cosmetic material to function properly for a long time. Also, the cosmetic material accommodation space in the refill container is maximized by removing an existing middle container and directly coupling the refill container to a container main body, thereby enabling effective filling of more cosmetic material to minimize frequent refilling of the cosmetic material. To this end, a coupling tension protrusion is formed on the inside of the container main body to allow easy assembly of the refill container by elastically moving the coupling tension protrusion when the refill container is assembled, and a coupling protrusion is formed on the coupling tension protrusion so as to effectively fix the refill container to the container main body.

BACKGROUND ART

Cosmetics refer to goods which are used for a human body in order to add charming of the human body and change the appearance of the human body to be brighter, or to maintain or enhance skin or hair in a healthy state by making the human body clean and beautiful, and have a minor effect on the human body.

In general, cosmetics are manufactured by mixing mutually different materials using an emulsifying agent such as a surface active agent, and the cosmetic materials may be classified into water-in-oil (W/O) emulsion type cosmetic material and oil in-water (O/W) emulsion type cosmetic material according to the bonding structure between water-based material and oil-based material.

The water-in-oil emulsion type cosmetic material, which is obtained by bonding an oil-based material to an outside of water-based material, has a larger quantity of oil so that the absorption of skin is slow and the touch feeling is heavy, but the persistence is longer than that of the oil-in-water emulsion type cosmetic material. Thus, the cosmetics requiring persistence are manufactured by using the W/O emulsion type cosmetic material to increase water resistance against sweat and water.

The cosmetics are manufactured reduce the viscosity of content in order to compensate the defects of the W/O emulsion type cosmetic material that the touch feeling is heavy and sticky. However, when the water-in-oil product having low viscosity remains for a long time in circulation, the aqueous material of internal phase and the oil materials of external phase may be separated from each other. In this case, a user shakes a container to mix the separated aqueous and oil materials with each other for use, but it is inconvenient to shake the container for use.

To solve the problems described above, as shown in FIG. 1, a product, which disclosed in Korean Registered Utility Model No. 20-0473583 issued to the applicant of the present application, has been developed, where an impregnation member 1 impregnated with water-in-oil contents having low viscosity is contained in a compact container.

However, according to the related art described above, though the refill container lid 6 is put on the refill container 3 to tightly close the refill container 3, since the refill container lid 6 and the refill container 3 are made of a synthetic resin material, a gap is generated due to the nature of the material, so that the sealing strength is lowered and the cosmetic material is volatilized or evaporated.

In addition, according to the related art described above, since the refill container 3 is coupled to the intermediate container 2 and the space occupied by the container main body 1 is large, the amount of the cosmetic material contained in the refill container 3 is reduced so that the refill container 3 is required to be frequently refilled with the cosmetic material. Therefore, there is a need to develop a container capable of efficiently containing a large amount of cosmetics by minimizing internal components.

DISCLOSURE

Technical Problem

To solve the problems described above, an object of the present invention is to provide a compact container provided with an airtight packing having upper and lower sealing rubbers, and a coupling tension protrusion, in which the airtight packing is coupled on top of a refill container, wherein the airtight packing is integrally formed with the upper and lower sealing rubbers made from a rubber material, wherein the upper sealing rubber is brought into close contact with a refill container cover and the lower sealing rubber is brought into close contact with the refill container, so as to render airtight a cosmetic material accommodating space, thereby preventing cosmetic material from evaporating or becoming volatile to allow the cosmetic material to function properly for a long time.

In addition, another object of the present invention is to provide a compact container provided with an airtight packing having upper and lower sealing rubbers, and a coupling tension protrusion, in which the cosmetic material accommodation space in the refill container is maximized by removing an existing middle container and directly coupling the refill container to a container main body, thereby enabling effective filling of more cosmetic material to minimize frequent refilling of the cosmetic material. To this end, a coupling tension protrusion is formed on the inside of the container main body to allow easy assembly of the refill container by elastically moving the coupling tension protrusion when the refill container is assembled, and a coupling protrusion is formed on the coupling tension protrusion so as to effectively fix the refill container to the container main body.

Technical Solution

According to the present invention, there is provided a compact container provided with an airtight packing having upper and lower sealing rubbers, and a coupling tension protrusion, which includes:

a container body (10) integrally formed at an inside thereof with the coupling tension protrusion (11);

a container lid (20) hinge-coupled to the container body (10) to open or close the container body (10) and formed on one side thereof with an opening/closing button (21);

a refill container (30) installed in the container body (10) and formed with a cosmetic material containing space (31);

the airtight packing (50) coupled to an upper portion of the refill container (30); and a refill container lid (60) hinge-coupled to the refill container (30) to open or close the refill container (30) and formed on a lower end thereof with a sealing ring protrusion wheel (63), wherein the upper sealing rubber (51) is formed integrally on an upper side of the airtight packing (50) and is tightly closed to the sealing ring protrusion wheel (63) of the refill container lid (60), and a lower sealing rubber (52) is formed integrally on a lower side of the airtight packing (50) and is tightly closed to an inner upper side of the refill container (30).

In addition, the coupling tension protrusion (11) extends while being spaced inwardly from the container body (10) by a predetermined interval such that an elastic space (13) is formed between the coupling tension protrusion (11) and the container body (10) to allow the coupling tension protrusion (11) to elastically move therein.

In addition, the compact container further includes a coupling protrusion (12) formed at an inside of the coupling tension protrusion (11), wherein the coupling protrusion (12) is coupled into a coupling groove (32) formed on an outer peripheral surface of a lower portion of the refill container (30).

In addition, the compact container further includes an impregnating member (40) contained in the cosmetic material containing space (31) of the refill container (30).

In addition, the refill container (30) includes an inner wall (34) and an outer wall (35) extending while being spaced outwardly from the inner wall (34) by a predetermined interval.

In addition, the upper and lower sealing rubbers (51 and 52) are formed on upper and lower portions of the airtight packing (50) in a dual injection or insert injection molding scheme.

In addition, the upper and lower sealing rubbers (52) are formed of an elastic rubber material which includes at least one of natural rubber, elastomer, acrylonitrile-butadiene rubber (NBR), and silicon rubber.

In addition, the compact container further includes a sealing protrusion wheel rubber (53) protruding from an outside of the lower sealing rubber (52), wherein the sealing protrusion wheel rubber (53) is pressed against and tightly closed to an upper end of an inner wall (34) formed on the refill container (30).

In addition, the airtight packing (50) is formed at a lower portion thereof with a lower extension portion (54), and a coupling groove (55) is formed on an inner peripheral surface of the lower extension portion (54).

In addition, the compact container further includes a coupling protrusion (36) formed on an outer peripheral surface of the inner wall (34), wherein the coupling protrusion (36) is coupled into a coupling groove (55) formed on an inner peripheral surface of a lower extension portion (54).

Advantageous Effects

According to the compact container provided with an airtight packing having upper and lower sealing rubbers, and a coupling tension protrusion of the present invention, in which the airtight packing is coupled on top of a refill container, wherein the airtight packing is integrally formed with the upper and lower sealing rubbers made from a rubber material, wherein the upper sealing rubber is brought into close contact with a refill container cover and the lower sealing rubber is brought into close contact with the refill container, so as to render airtight a cosmetic material accommodating space, thereby preventing cosmetic material from evaporating or becoming volatile to allow the cosmetic material to function properly for a long time.

In addition, the cosmetic material accommodation space in the refill container is maximized by removing an existing middle container and directly coupling the refill container to a container main body, thereby enabling effective filling of more cosmetic material to minimize frequent refilling of the cosmetic material. To this end, a coupling tension protrusion is formed on the inside of the container main body to allow easy assembly of the refill container by elastically moving the coupling tension protrusion when the refill container is assembled, and a coupling protrusion is formed on the coupling tension protrusion so as to effectively fix the refill container to the container main body.

BEST MODE

Mode for Invention

Hereinafter, a compact container provided with an airtight packing having upper and lower sealing rubbers, and a coupling tension protrusion according to an embodiment of the present invention will be described with reference to accompanying drawings.

Figure 2:
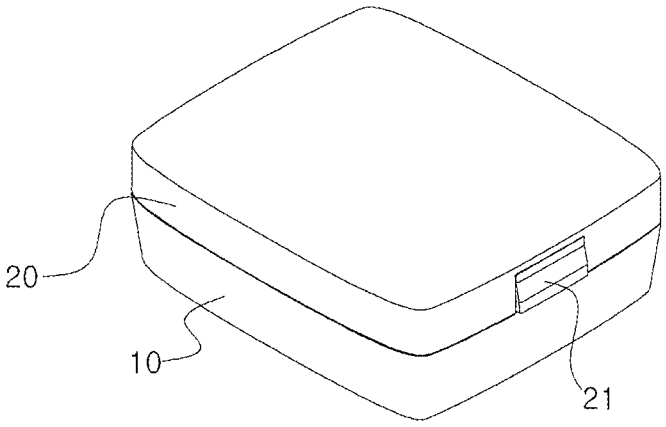
FIG. 2 is a perspective view showing a compact container provided with an airtight packing having upper and lower sealing rubbers, and a coupling tension protrusion according to an embodiment of the present invention.
Figure 3:
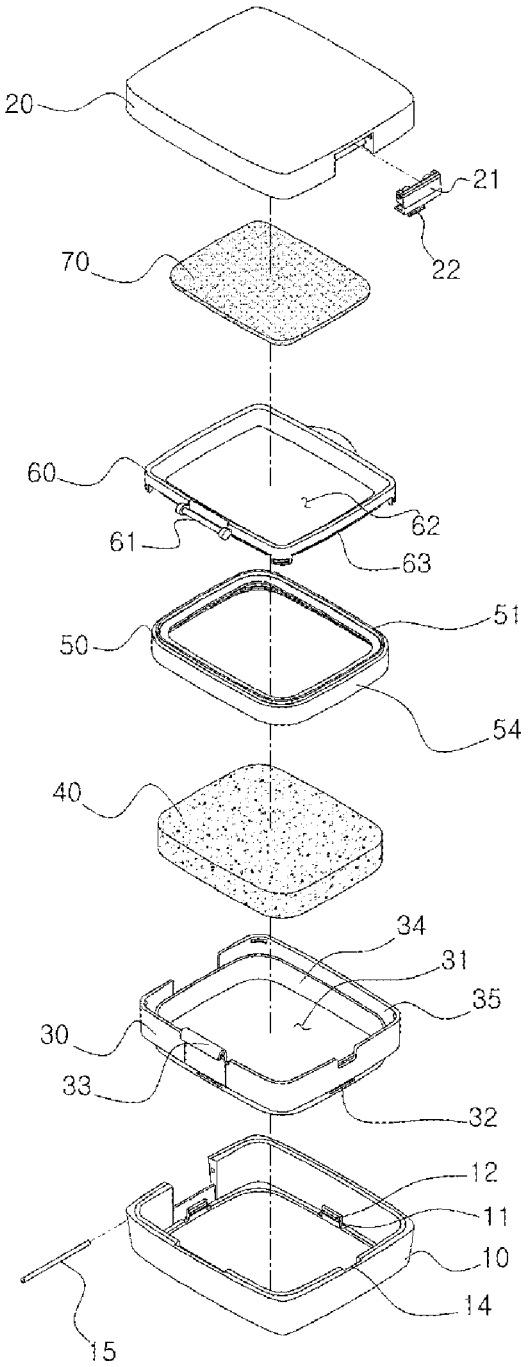
FIG. 3 is an exploded perspective view showing a compact container provided with an airtight packing having upper and lower sealing rubbers, and a coupling tension protrusion according to an embodiment of the present invention.
Figure 4:
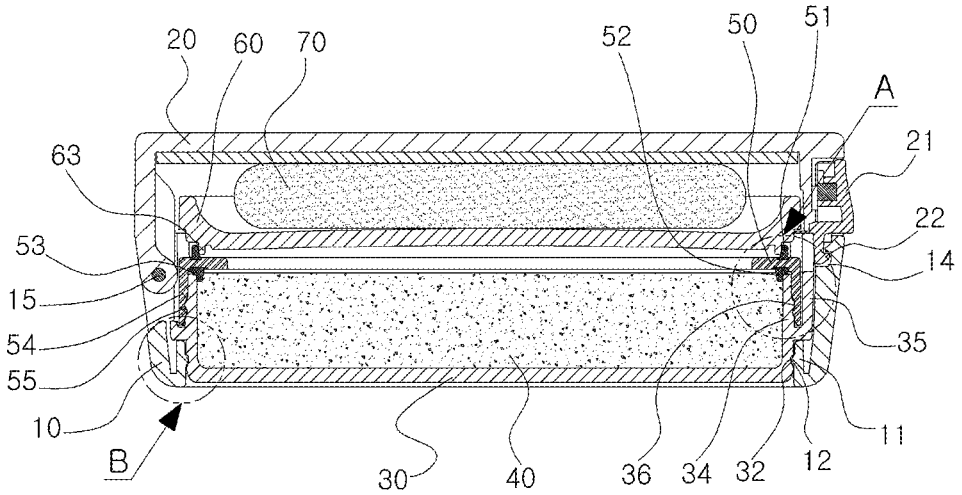
FIG. 4 is a sectional view showing a compact container provided with an airtight packing having upper and lower sealing rubbers, and a coupling tension protrusion according to an embodiment of the present invention.
Figure 5:
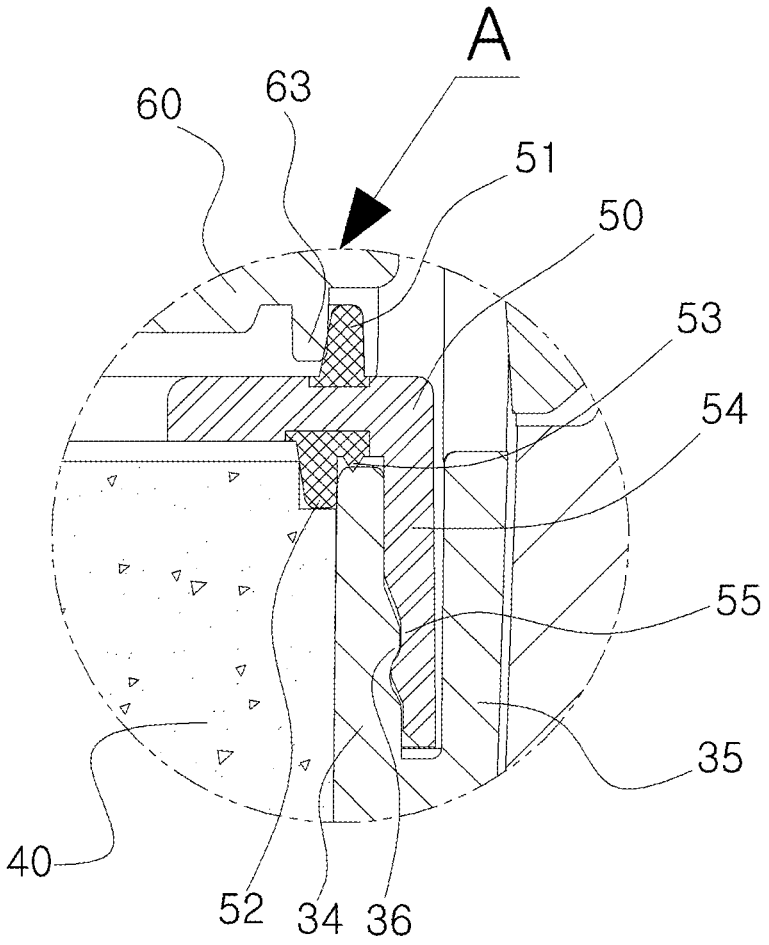
FIG. 5 is an enlarged view of portion 'A' of FIG. 4.
Figure 6:
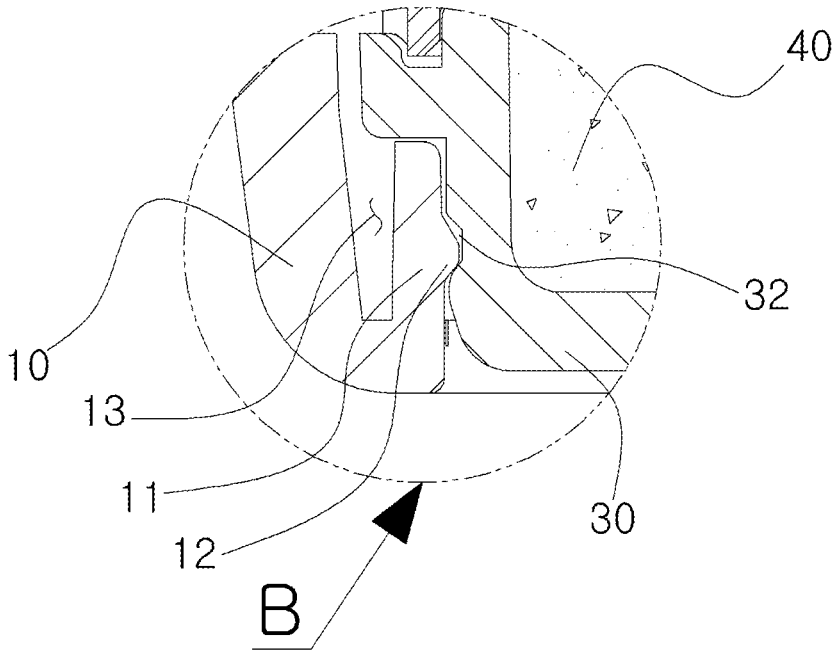
FIG. 6 is an enlarged view of portion 'B' of FIG. 4.
Figure 7:
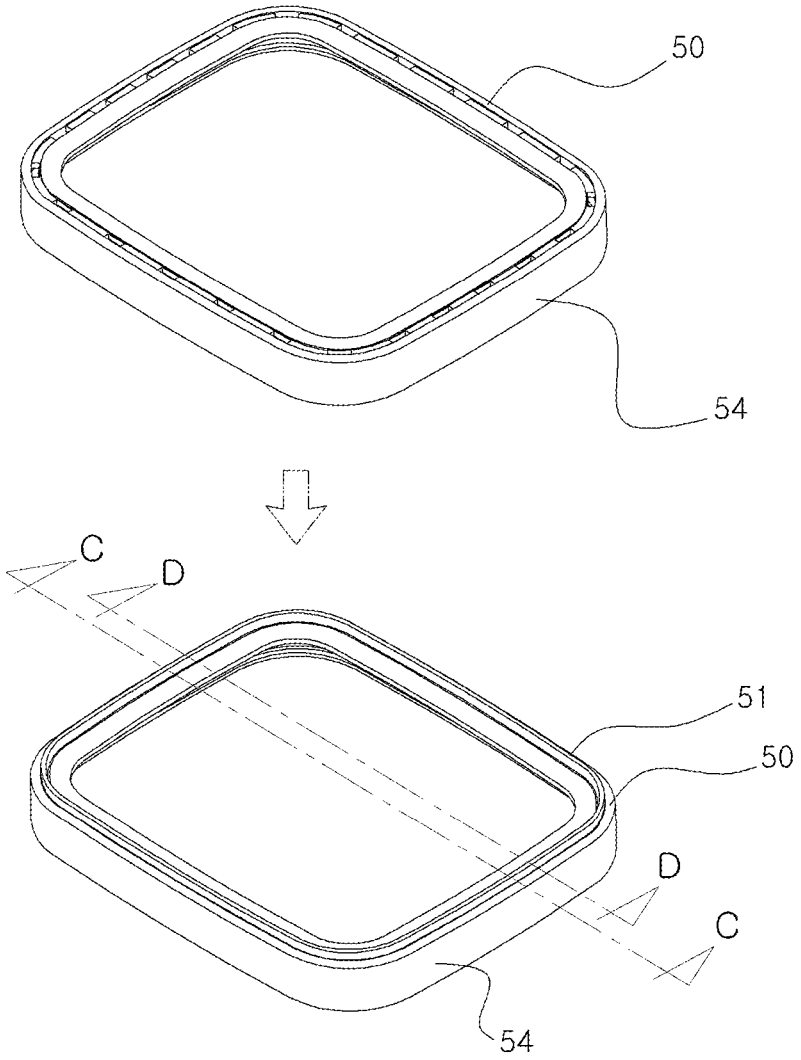
FIG. 7 is a sectional view showing a state where upper and lower sealing rubbers are formed on an airtight packing of the compact container provided with an airtight packing having upper and lower sealing rubbers, and a coupling tension protrusion according to an embodiment of the present invention.
Figure 8:
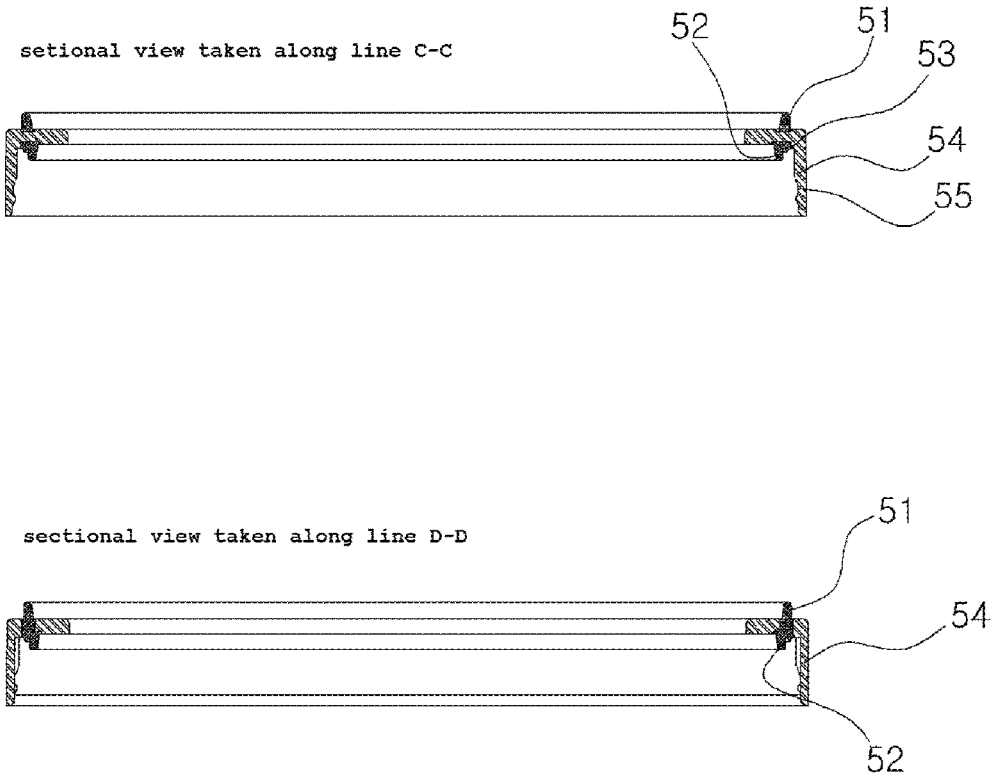
FIG. 8 is a sectional view taken along line C-C of FIG. 7.

FIG. 2 is a perspective view showing a compact container provided with an airtight packing having upper and lower sealing rubbers, and a coupling tension protrusion according to an embodiment of the present invention. FIG. 3 is an exploded perspective view showing a compact container provided with an airtight packing having upper and lower sealing rubbers, and a coupling tension protrusion according to an embodiment of the present invention. FIG. 4 is a sectional view showing a compact container provided with an airtight packing having upper and lower sealing rubbers, and a coupling tension protrusion according to an embodiment of the present invention. FIG. 5 is an enlarged view of portion 'A' of FIG. 4. FIG. 6 is an enlarged view of portion 'B' of FIG. 4. FIG. 7 is a sectional view showing a state where upper and lower sealing rubbers are formed on an airtight packing of the compact container provided with an airtight packing having upper and lower sealing rubbers, and a coupling tension protrusion according to an embodiment of the present invention. FIG. 8 is a sectional view taken along line C-C of FIG. 7.

A compact container provided with an airtight packing having upper and lower sealing rubbers, and a coupling tension protrusion according to an embodiment of the present invention includes a container body 10 integrally formed an inside thereof with the coupling tension protrusion 11, a container lid 20 hinge-coupled to the container body 10 to open or close the container body 10 and formed on one side thereof with an opening/closing button 21, a refill container 30 installed into the container body 10 and formed with a cosmetic material containing space 31, the airtight packing 50 coupled to an upper portion of the refill container 30, and a refill container lid 60 hinge-coupled to the refill container 30 to open or close the refill container 30 and formed on a lower end thereof with a sealing ring protrusion wheel 63, wherein the upper sealing rubber 51 is formed integrally on an upper side of the airtight packing 50 and is tightly closed to the sealing ring protrusion wheel 63 of the refill container lid 60, and the lower sealing rubber 52 is formed integrally on a lower side of the airtight packing 50 and is tightly closed to an inner upper side of the refill container 30.

The refill container 30 is contained in the container body 10 and the coupling tension protrusion 11 is integrally formed inside the container body 10. In addition, a locking groove 14 is formed on one side of the container body 10.

The coupling tension protrusion 11 extends inwardly from the container body 10 and is spaced apart from the container body 10 by a predetermined interval, such that an elastic space 13 is formed between the coupling tension protrusion 11 and the container body 10 to allow the coupling tension protrusion 11 to move elastically therein.

A coupling protrusion 12 is formed at an inside of the coupling tension protrusion 11. As shown in FIG. 6, the coupling protrusion 12 is coupled into a coupling groove 32 formed on an outer peripheral surface of a lower portion of the refill container (30) such that the refill container 30 is prevented from being separated from the container body 10.

A hinge is formed on a side opposite to the locking groove 14 and hinge-coupled to the container lid 20 with a hinge pin 15.

The container lid 20, which covers an upper portion of the container body 10, is hinge coupled to the container body 10 to open or close the container body 10.

The opening/closing button 21 is formed on one side of the container lid 20, where the opening/closing button 21 is formed at a position corresponding to the locking groove 14 of the container body 10.

A locking protrusion 22 is formed at the center of a lower side of the opening/closing button 21. The locking protrusion 22 is formed in a protrusion shape to be latch-coupled into the locking groove 14.

Figure 1:
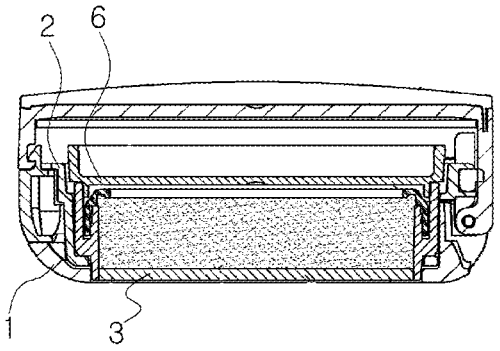
FIG. 1 is a sectional view showing a compact container according to the related art.

As shown in FIG. 1, the opening/closing button 21 formed on the container lid 20 enables the containing space of an opening/closing button occupying the container body 1 according to the related art to be removed and enables the intermediate container 2 required to assemble the opening/closing button to be removed, so that the cosmetic material containing space is maximized to be effectively filled with the cosmetic material. Thus, the cosmetic material may be effectively filled, thereby minimizing the inconvenience of frequent refilling of contents.

The refill container 30 is installed into the container body 10 and formed with the cosmetic material containing space 31.

The cosmetic material may be directly contained in the cosmetic material containing space 31 or an impregnating member 40 impregnated with the cosmetic material may be installed into the cosmetic material containing space 31.

The coupling groove 32 is formed on an outer peripheral surface of the refill container 30. A hinge hook 33 is integrally formed on one side of an upper portion of the refill container 30. An outer wall 35 is spaced apart from an inner wall 34 by a predetermined interval.

As shown in FIG. 6, the coupling groove 32 is coupled to the coupling protrusion 12 formed inside the coupling tension protrusion 11 of the container body 10.

The hinge hook 33 is fastened to a hinge protrusion 61 formed on one side of the outer peripheral surface of the refill container lid 60 in a hook latch scheme.

The airtight packing 50 is coupled to an outer peripheral surface of the inner wall 34.

The airtight packing 50 is formed on an upper side thereof with an upper sealing rubber 51 and on a lower side thereof with a lower sealing rubber 52.

As shown in FIGS. 7 and 8, the upper and lower sealing rubbers 51 and 52 are formed on the upper and lower portions of the airtight packing 50 in a dual injection or insert injection molding scheme, and are formed of an elastic rubber material which specifically includes at least one of natural rubber, elastomer, acrylonitrile-butadiene rubber (NBR), and silicon rubber.

As shown in FIG. 5, the upper sealing rubber 51 is tightly closed to the sealing ring protrusion wheel 63 and the lower sealing rubber 52 is tightly closed to an inner peripheral surface of the inner wall 34 of the refill container 30 to seal the cosmetic material containing space 31 of the refill container 30, such that the cosmetic material may be prevented from being volatilized and evaporated, thereby allowing the cosmetic material to operate its functions for a long time.

In addition, a sealing protrusion wheel rubber 53 protrudes from an outside of the lower sealing rubber 52. The sealing protrusion wheel rubber 53 is pressed against and tightly closed to an upper end of an inner wall 34 formed on the refill container 30.

The airtight packing 50 is formed with a lower extension portion 54 extending downwardly thereof, and a coupling groove 55 is formed on an inner peripheral surface of the lower extension portion 54.

As shown in FIG. 5, the coupling groove 55 is coupled with a coupling protrusion 36 formed on an outer peripheral surface of the inner wall 34 of the refill container 30 such that the airtight packing 50 is prevented from being separated from the refill container 30.

The refill container lid 60 is coupled to the refill container 30 to open or close the refill container 30.

A hinge protrusion 61 is formed on one side of an outer peripheral surface of the refill container lid 60. A puff containing portion 62 capable of containing a puff 90 is formed on an upper side of the outer peripheral surface of the refill container lid 60. A sealing ring protrusion wheel 63 is formed on a lower end of the outer peripheral surface of the refill container lid 60.

The hinge protrusion 61 is coupled to the hinge hook 33, which is formed on one side of an upper portion of the refill container 30, in a hook latch scheme, so that the refill container lid 60 and the refill container 30 are not fixed with a pin but coupled to each other in the hook latch scheme. Thus, the number of components required for manufacture is reduced so that the manufacturing costing may be reduced.

The puff 70 is kept in the puff containing portion 62 to easily get the cosmetic material contained in the refill container 30 for use.

As shown in FIG. 5, the sealing ring protrusion wheel 63 is forcibly fitted into an inside of the upper sealing rubber 51 of the airtight packing 50 to seal the refill container 30.

A method of assembling a compact container provided with an airtight packing having upper and lower sealing rubbers, and a coupling tension protrusion according to an embodiment of the present invention and the using state thereof will be described in detail as follows.

To assemble the compact container provided with an airtight packing having upper and lower sealing rubbers, and a coupling tension protrusion according to an embodiment of the present invention, the container lid 20 is hinge-coupled to the container body 10, on one side of which the coupling tension protrusion 11 is integrally formed.

Then, as shown in FIG. 5, the coupling groove 32, which is formed on the lower outer peripheral surface of the refill container 30 is coupled with the coupling protrusion 12 formed on the inside of the coupling tension protrusion 11 of the container body 10.

In this case, the coupling tension protrusion 11 may elastically move to easily assemble the refill container 30 and effectively fix the refill container 30 to the container body 10.

Then, The hinge hook 33 formed on one side of the refill container 30 is coupled with the hinge protrusion 61 formed on one side of the outer peripheral surface of the refill container lid 60 in a hook latch scheme, so that the refill container lid 60 and the refill container 30 are coupled to each other.

The cosmetic material may be directly contained in the refill container 30, or the impregnating member 40 impregnated with the cosmetic material may be installed in the refill container 30.

In addition, the airtight packing 50, which is formed with the upper and lower sealing rubbers 51 and 52 is coupled to the inner wall 34 of the refill container 30, so that the assembly is completed.

To use the compact container provided with an airtight packing having upper and lower sealing rubbers, and a coupling tension protrusion assembled in the above-described method, the opening/closing button 21 formed on one side of the container lid 20 is pushed to open the container lid 20.

Then, after the puff 70 is held, the refill container lid 60 is opened to get the cosmetic material contained in the refill container 30 for use.

When the refill container lid 60 is closed to seal the refill container 30 after using the cosmetic material in the refill container 30, the airtight packing 50 is coupled to the upper portion of the refill container 30.

The airtight packing 50 is formed with the upper and lower sealing rubbers 51 and 52. The upper sealing rubber 51 is tightly closed to the sealing ring protrusion wheel 63 formed on the refill container lid 60. The lower sealing rubber 52 is tightly closed to the inner peripheral surface of the inner wall 34 of the refill container 30, so that the cosmetic material containing space 31 of the refill container 30 is sealed. Thus, the cosmetic material is prevented from being volatilized and evaporated, thereby allowing the cosmetic material to operate its functions for a long time.

As described above, the compact container provided with an airtight packing having upper and lower sealing rubbers, and a coupling tension protrusion described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container body
11: Coupling tension protrusion
12: Coupling protrusion
13: Elastic space
14: Locking groove
15: Hinge pin
20: Container lid
21: Opening/closing button
22: Locking protrusion
30: Refill container
31: Cosmetic material containing space
32: Coupling groove
33: Hinge hook
34: Inner wall
35: Outer wall
36: Coupling protrusion
40: Impregnating member
50: Airtight packing
51: Upper sealing rubber
52: Lower sealing rubber
53: Sealing protrusion wheel
54: Lower extension portion
55: Coupling groove
60: Refill container lid
61: Hinge protrusion
62: Puff containing portion
63: Sealing ring protrusion wheel
70: Puff

The invention claimed is:

1. A compact container comprising:

a container body (10) integrally formed at an inside thereof with a coupling tension protrusion (11);

a container lid (20) hinge-coupled to the container body (10) to open or close the container body (10) and formed on one side thereof with an opening/closing button (21);

a refill container (30) installed in the container body (10) and formed with a cosmetic material containing space (31);

an airtight packing (50) comprising an upper sealing rubber (51) and a lower sealing rubber (52) wherein the airtight packing (50) is coupled to an upper portion of the refill container (30); and a refill container lid (60) hinge-coupled to the refill container (30) to open or close the refill container (30) and formed on a lower end thereof with a sealing ring protrusion wheel (63), wherein the coupling tension protrusion (11) extends from the inside of the container body (10) while being spaced inwardly from the container body (10) by a predetermined interval such that an elastic space (13) is formed between the coupling tension protrusion (11) and the container body (10) to allow the coupling tension protrusion (11) to elastically move therein, and wherein the upper sealing rubber (51) is formed integrally on and protruding upwardly from an upper side of the airtight packing (50) and is tightly closed against an outwardly facing side of the sealing ring protrusion wheel (63) of the refill container lid (60), and the lower sealing rubber (52) is formed integrally on and protruding downwardly from a lower side of the airtight packing (50) and is tightly closed upon an inner upper side of the refill container (30).

2. The compact container of claim 1, further comprising a coupling protrusion (12) formed at an inside of the coupling tension protrusion (11), wherein the coupling protrusion (12) is coupled into a coupling groove (32) formed on an outer peripheral surface of a lower portion of the refill container (30).

3. The compact container of claim 1, further comprising an impregnating member (40) contained in the cosmetic material containing space (31) of the refill container (30).

4. The compact container of claim 1, wherein the refill container (30) includes an inner wall (34) and an outer wall (35) extending while being spaced outwardly from the inner wall (34) by a predetermined interval.

5. The compact container of claim 4, further comprising a coupling protrusion (36) formed on an outer peripheral surface of the inner wall (34), wherein the coupling protrusion (36) is coupled into a coupling groove (55) formed on an inner peripheral surface of a lower extension portion (54).

6. The compact container of claim 1, wherein the upper and lower sealing rubbers (51 and 52) are formed on the upper and the lower portions of the airtight packing (50) in a dual injection or insert injection molding scheme.

7. The compact container of claim 1, wherein the upper and lower sealing rubbers (52) are formed of an elastic rubber material which includes at least one of natural rubber, elastomer, acrylonitrile-butadiene rubber (NBR), and silicon rubber.

8. The compact container of claim 1, further comprising a sealing protrusion wheel rubber (53) protruding from an outside of the lower sealing rubber (52), wherein the sealing protrusion wheel rubber (53) is pressed against and tightly closed to an upper end of an inner wall (34) formed on the refill container (30).

9. The compact container of claim 1, wherein the airtight packing (50) is formed at a lower portion thereof with a lower extension portion (54), and a coupling groove (55) is formed on an inner peripheral surface of the lower extension portion (54).

* * * * *